US005819954A

United States Patent [19]

Lacriola

[11] Patent Number: 5,819,954

[45] Date of Patent: Oct. 13, 1998

[54] COUPON SORTING SYSTEM AND METHOD OF SORTING COUPONS

[75] Inventor: John Michael Lacriola, Riverside, Calif.

[73] Assignee: Ralphs Grocery Company, Los Angeles, Calif.

[21] Appl. No.: 128,976

[22] Filed: Sep. 29, 1993

[51] Int. Cl.[6] ..... B07C 5/00; B65H 3/08

[52] U.S. Cl. ..... 209/563; 209/643; 209/644; 209/900; 198/349; 198/349.95; 198/367; 414/744.2; 414/797

[58] Field of Search ..... 209/559, 563, 209/576, 577, 583, 643, 644, 900, 917; 198/349, 349.95, 367, 502.3, 813, 814; 414/744.2, 797

[56] References Cited

U.S. PATENT DOCUMENTS

| | | | |
|---|---|---|---|
| 2,717,086 | 9/1955 | Bush | 198/349 X |
| 3,146,902 | 9/1964 | Voelker | 414/797 X |
| 3,166,540 | 1/1965 | Melamed et al. . | |
| 3,215,271 | 11/1965 | Cecchini . | |
| 3,674,141 | 7/1972 | Abraham et al. . | |
| 3,718,197 | 2/1973 | Barten et al. | 198/814 X |
| 3,721,340 | 3/1973 | Kruse et al. | 209/643 X |
| 3,928,184 | 12/1975 | Anschutz | 209/644 X |
| 4,166,540 | 9/1979 | Marshall . | |
| 4,350,466 | 9/1982 | Bahr et al. | 414/797 X |
| 4,392,766 | 7/1983 | Blunt | 414/797 X |
| 4,791,281 | 12/1988 | Johnsen et al. . | |
| 4,882,675 | 11/1989 | Nichtberger et al. . | |
| 4,949,256 | 8/1990 | Humble . | |
| 5,128,520 | 7/1992 | Rando et al. . | |
| 5,173,851 | 12/1992 | Off et al. . | |
| 5,185,695 | 2/1993 | Pruchnicki . | |
| 5,186,336 | 2/1993 | Pippin et al. | 209/583 |
| 5,207,331 | 5/1993 | Teegarden et al. | 414/797 X |
| 5,295,586 | 3/1994 | Chesnutt et al. | 209/644 X |

FOREIGN PATENT DOCUMENTS

| | | | |
|---|---|---|---|
| 3914360 | 10/1990 | Germany | 209/644 |

*Primary Examiner*—Tuan N. Nguyen
*Attorney, Agent, or Firm*—Fulbright &Jaworski,L.L.P.

[57] ABSTRACT

A system for sorting coupons according to information contained within bar codes or similar markings printed thereon. The system includes a storage bin in which the coupons are received and from which they are removed one at a time. A coupon picker removes the coupon from the storage bin and deposits it upon a conveyor belt at a loading station. The information contained on the coupon is read by an appropriate scanner which ascertains through the use of an appropriate data processing system the address of a receiving bin in which the coupon is to be deposited. The position of the coupon on the conveyor belt is tracked and when the coupon arrives at the address of the receiving bin an air jet is activated to propel the coupon from the conveyor belt into the receiving bin.

23 Claims, 8 Drawing Sheets

FIG. 5
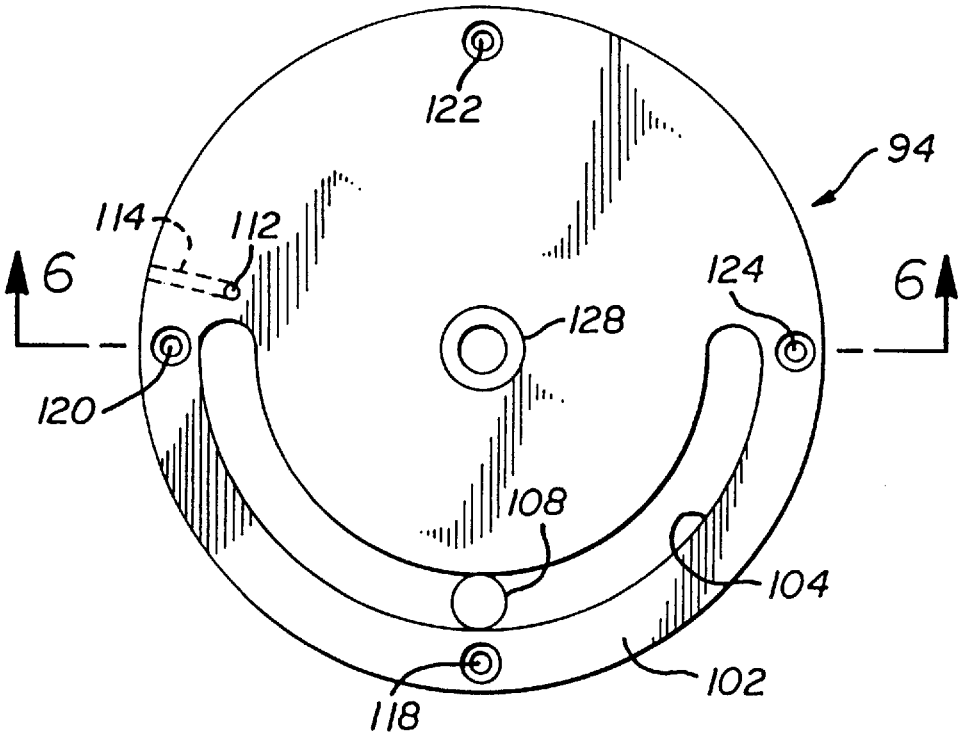
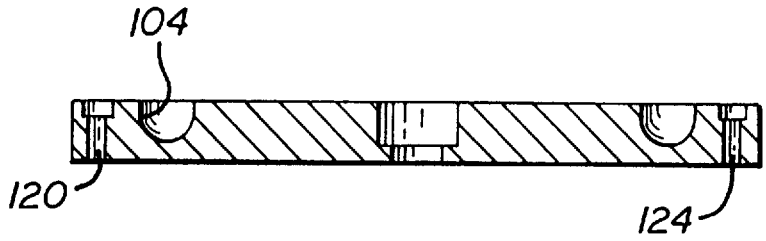
FIG. 6

FIG. 7
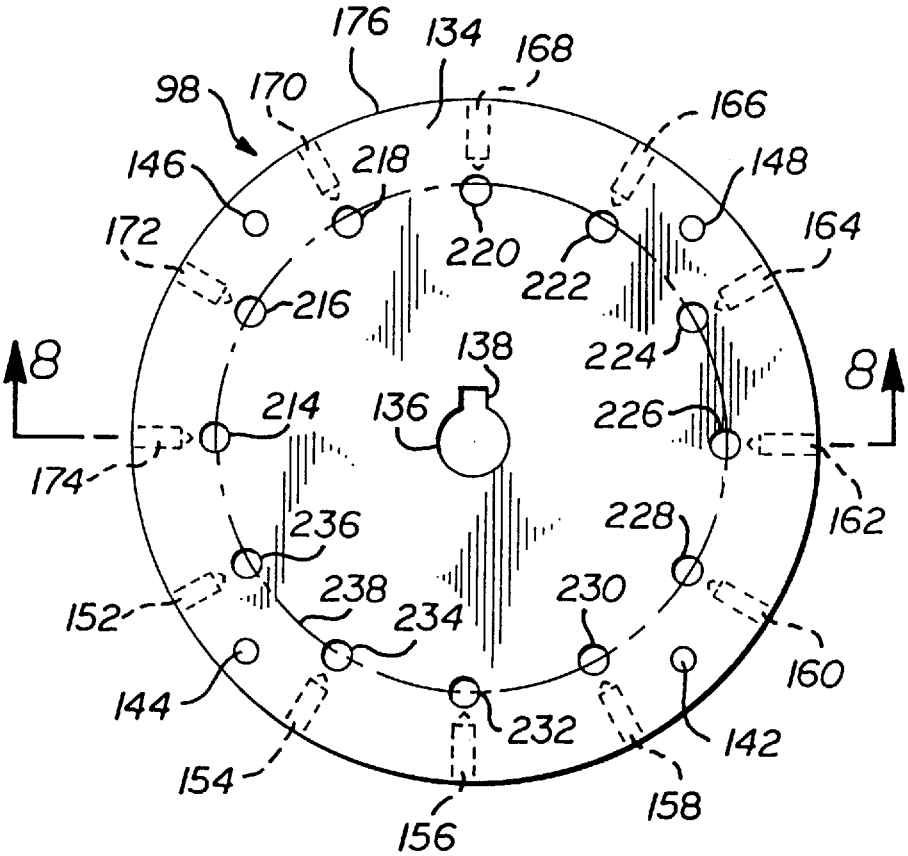
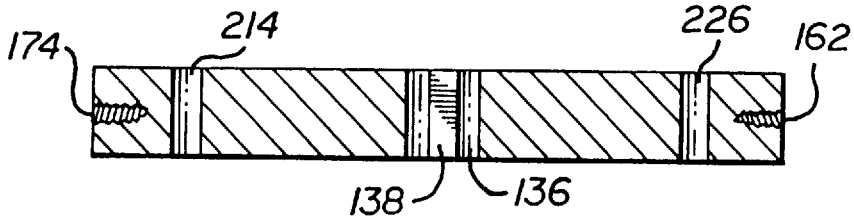
FIG. 8

FIG. 10
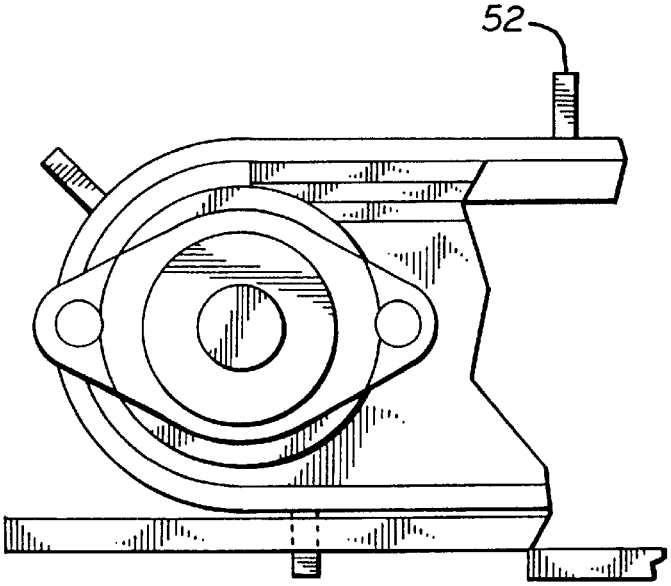
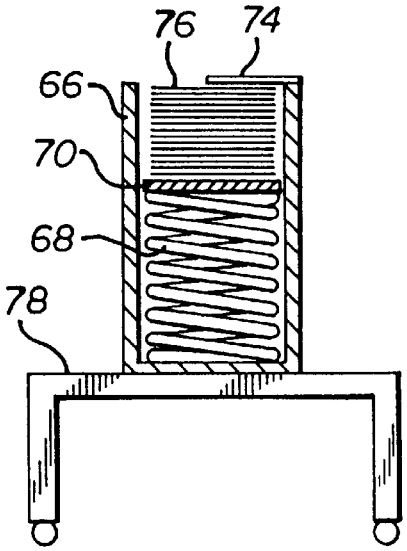
FIG. 11
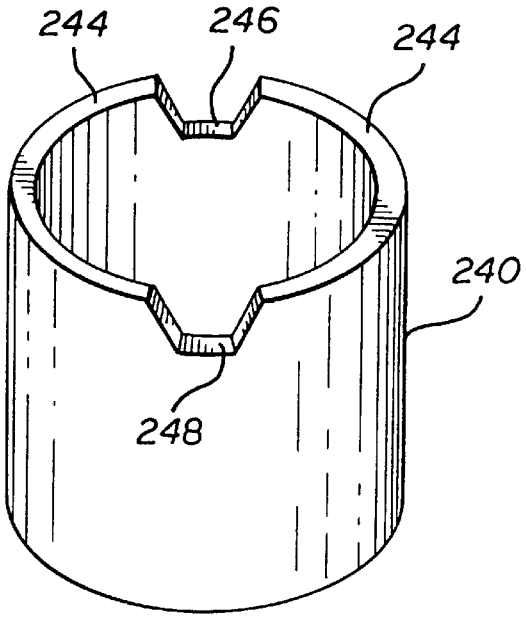
FIG. 12

COUPON SORTING SYSTEM AND METHOD OF SORTING COUPONS

BACKGROUND OF THE INVENTION

1. Field of the Invention

This invention relates generally to the field of handling articles in the form of a sheet or piece of material upon which there is contained identifying indicia and within which field there is included retail marketing promotions including granting of credits, acquisition of information and the like, utilizing coupons. The invention more particularly relates to a system which is suitable for automatically sorting such retail store coupons or the like and a method for accomplishing such sorting. For purposes of ease and clarity of description the following description will be limited to retail store coupons without the intent of limiting the scope of the claims thereto.

2. Prior Art

Coupons, for example, cents-off, two-for-one and the like, have become an accepted integral part of retail marketing, particularly for products such as food products and pharmaceutical products. Most coupons are issued by the manufacturers of the products and appear as individual coupons in newspapers and promotional material, such as flyers, direct mailers, and the like. Consumers collect such coupons as small pieces of paper sometimes in extremely large quantities. The coupons are presented for redemption at the check-out station along with a group of purchases. Each coupon is individually checked either with an electronic scanner or visually by the cashier to determine such things as whether the coupon is valid, i.e., the expiration has not expired, whether the consumer has purchased the correct quantity of products and the correct size of product and whether the coupon is one redeemable by the merchant as well as the value of the coupon. Thereafter, the values of such validated coupons are entered into the register for subtraction from the unadjusted aggregate purchase price. Those coupons which are collected by the retailers must be sorted and returned to the manufacturers appropriate credit. Such sorting is usually done by a professional clearing house and is done either manually or by utilization of optical electronic or mechanical equipment or a combination thereof. When the coupons are received by the clearing house they are read and sorted and the account of the retailer submitting the coupons is credited with the aggregate value of the coupons plus an appropriate handling charge while the various manufacturers accounts are debited accordingly. In addition, a report is submitted to certain manufacturers indicating the number and value of coupons redeemed, the origin of the redeemed coupons, that is whether they originated in a newspaper, promotional flyer, box top, magazine, or the like, the regions of the country in which the coupons were redeemed and other information desired by the manufacturer. The manufacturers must pay fees to the clearing houses and must pay handling fees to the retailers which increases the cost of the product promotions. The retailers incur an additional cost by reason of extending credit to the manufacturers by underwriting the discount values of the coupons at the time of purchase even though the retailer is reimbursed at a later time.

Typically, each manufacturer has a large number of offers outstanding relating to various products and to various sizes and flavors of that product. In addition, different offers are made by publishing similar coupons in various magazines, newspapers and other publications. When this is done the manufacturer usually desires to know the origin of each coupon in order to determine the effectiveness of the advertising campaign which is being used. Therefore, coupons relating to the same product which appear in different publications are typically segregated under different offers, each being identified by a different offer number. The number of separate offers is quite large and each coupon must be segregated according to offer. As can be seen, the number of separate offers requires a rather complicated segregation process that in the prior art typically requires each coupon to be handled a plurality of times. In addition, since the coupons are usually clipped out by the consumer prior to presentation to the retailer they will be of different sizes, printed on different types of paper, sometimes folded or crumpled. Such different sizes and types and quality of paper renders the sorting of the coupons, whether done manually or automatically quite difficult. Coupons used in such merchandising and promotions are now printed with a universal product code thereon. In addition, other information such as the manufacturer, the origin, the specific offer and the like are also contained within the code printed upon the coupon. This code typically is printed in the industry in the form of a bar code. As a result of the printing of such bar codes coupon scanning technology has also been developed and is readily available to those skilled in the art.

Automatic coupon sorting systems utilizing optical scanners, transport systems and mechanical diverters to deflect the coupon into a desired collecting bin are known in the art. The best prior art known to applicant for coupon sorting systems is shown in U.S. Pat. Nos. 3,166,540; 5,128,520 and 5,186,336. While the systems shown in such prior art do function to sort coupons, experience has shown there is at best a 95 percent accuracy in the coupon sorting. Such inaccuracy would result in 10,000 coupons per million coupons which would have to be resorted. It is not uncommon for a large retail grocery store supermarket chain to redeem several million coupons daily and for a clearing house to have to sort tens of millions of coupons daily. As a result, even a one percent error is not acceptable.

Applicant's system and method are designed to overcome the problems existing in the prior art and to provide substantially 100% sorting accuracy on a one time pass irrespective of the condition in which they are received by the retailer.

SUMMARY OF THE INVENTION

A system in accordance with the present invention, includes means for storing coupons so that one coupon at a time is exposed, means for removing said exposed coupon and depositing it within a pocket on a conveyor belt at a loading station, means for reading each coupon to ascertain information contained within bar codes or similar markings printed thereon, means for determining the address of a receiving bin within which each such coupon is to be deposited responsive to the information obtained by reading the coupon, means for tracking the position of the coupon on the moving conveyor belt to determine when the coupon arrives at the address of the receiving bin and means for activating an air jet to propel the coupon from the pocket on the conveyor belt into the appropriate receiving bin.

The method of the present invention includes the steps of removing the coupons one at a time from a storage magazine and depositing each such coupon within a pocket defined by a moving conveyor belt at a loading station, reading each such coupon to ascertain information therefrom regarding its source and offer, identifying from such information a predetermined address of a receiving bin into which such coupon is to be deposited, tracking the position of the coupon on the conveyor belt to determine when the coupon arrives at the address of the receiving bin and activating an air jet to propel the coupon from the belt into the appropriate receiving bin.

BRIEF DESCRIPTION OF THE DRAWINGS

FIG. 5 is a top plan view of a vacuum plate used in the picker apparatus as illustrated in FIG. 4;

FIG. 6 is a cross sectional view of the vacuum plate illustrated in FIG. 5 taken about the lines 6—6 thereof;

FIG. 7 is a top plan view of a picker arm plate as used in the structure illustrated in FIG. 4;

FIG. 8 is a cross sectional view of the picker arm plate shown in FIG. 7 taken about the lines 8—8 thereof;

FIG. 10 is a side elevational view of the structure shown in FIG. 9;

FIG. 11 is a schematic representation in cross section of a magazine or hopper used to store the coupons for sorting; and FIG. 12 is a schematic representation of a cam member used with the picker means.

DETAILED DESCRIPTION OF THE INVENTION

Figure 1:
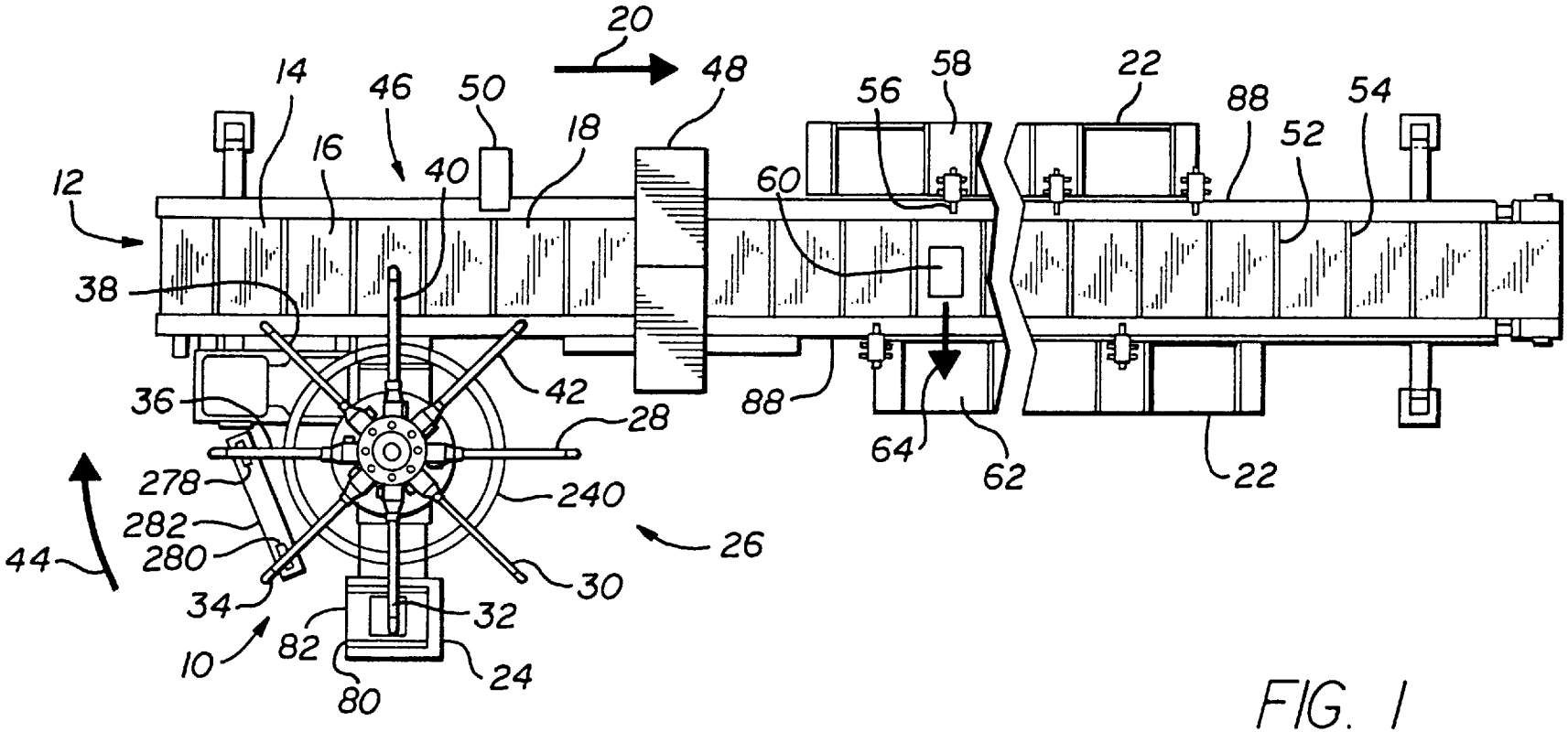
FIG. 1 is a schematic representation in top plan view of a coupon sorting system constructed in accordance with the present invention.
Figure 2:
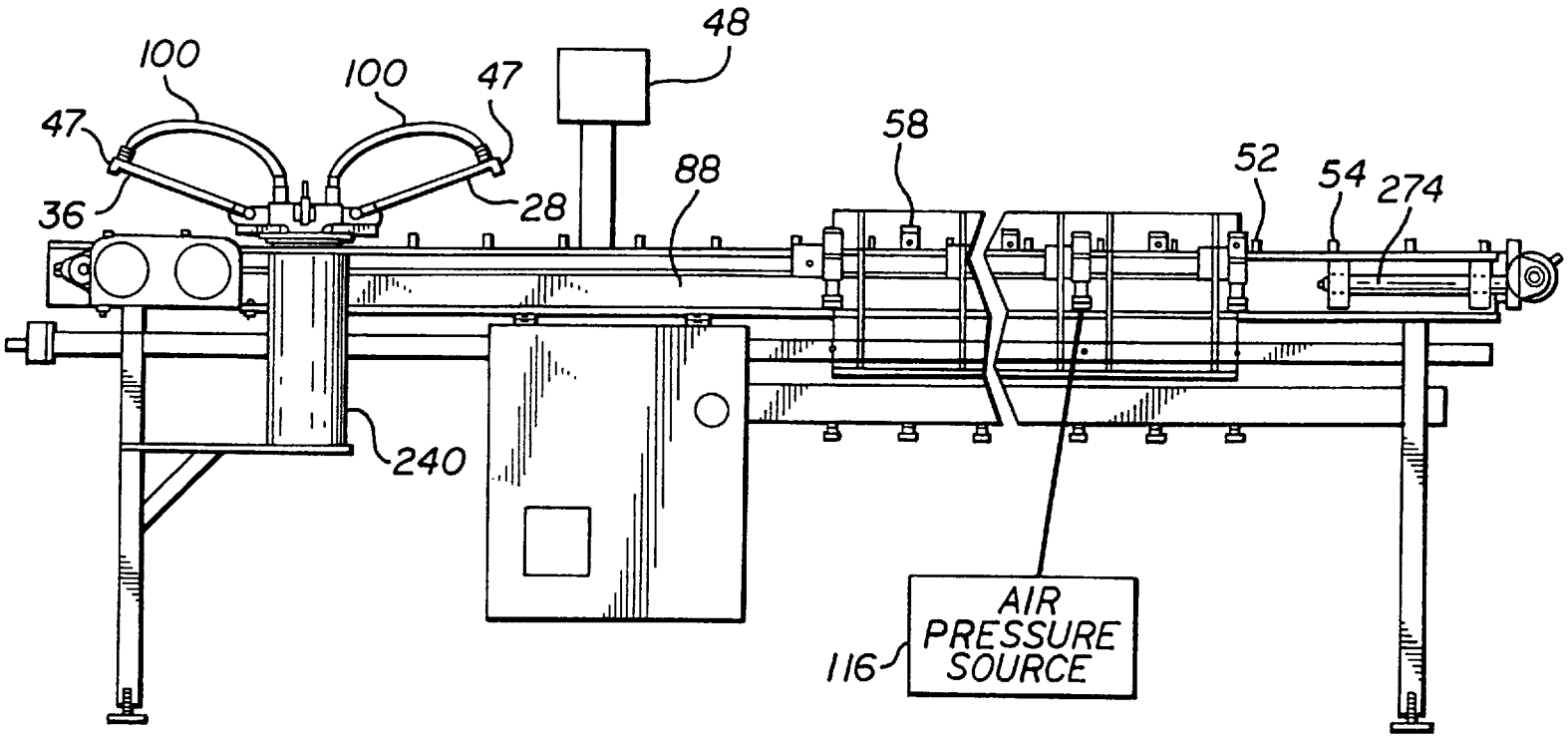
FIG. 2 is a side elevational view of the apparatus disclosed in FIG. 1.
Figure 3:
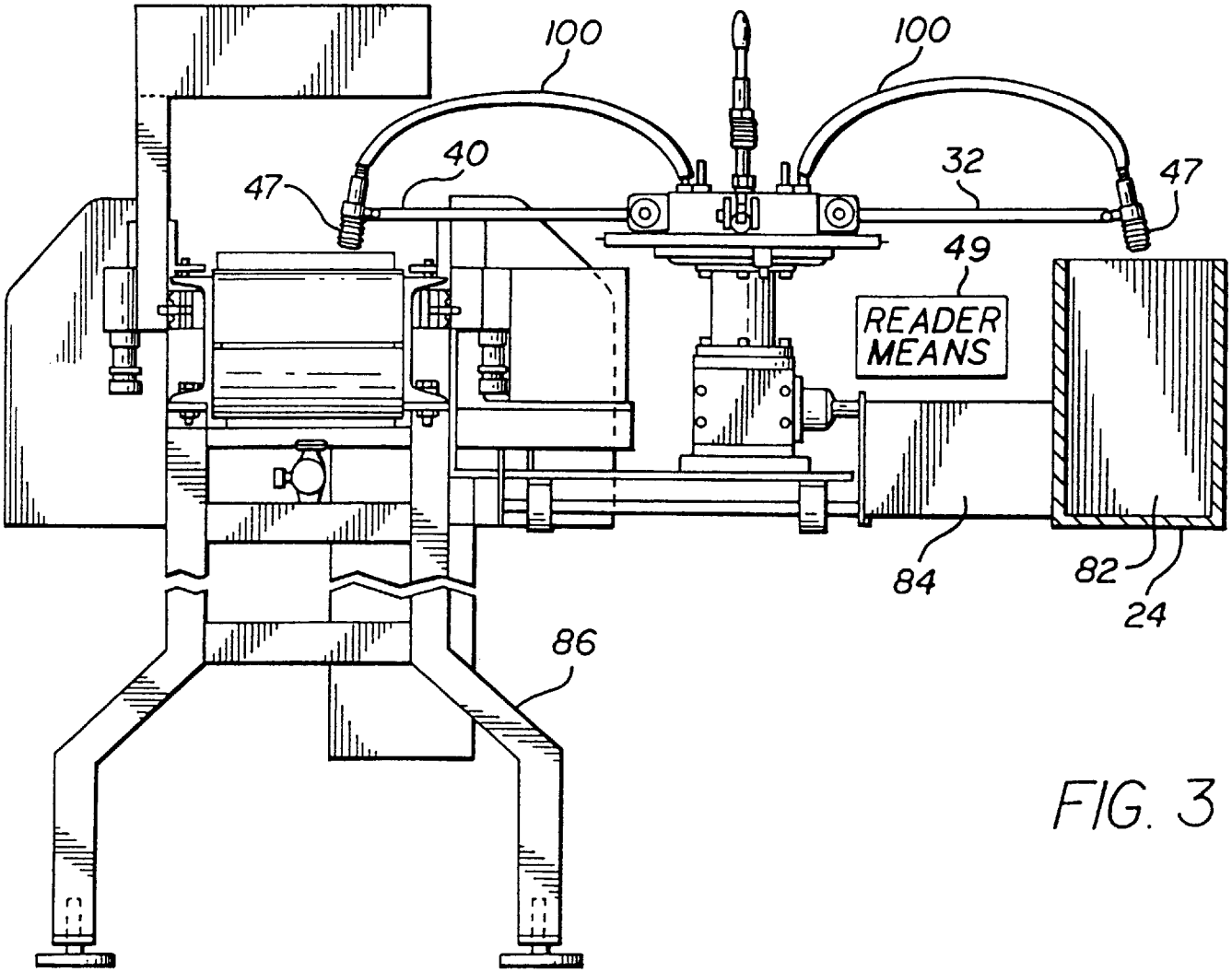
FIG. 3 is an end elevational view of the apparatus as shown in FIG. 1.

Referring now to FIGS. 1 through 3 there is illustrated schematically an automatic retail store coupon sorter system 10 constructed in accordance with the principles of the present invention. As is shown the system 10 includes a conveyor belt 12 which is separated into a plurality of pockets as shown at 14, 16, and 18. The conveyor belt 12 moves continuously during operation in the direction illustrated by the arrow 20. A plurality of destination bins 22 are illustrated along opposed sides of the conveyor belt 12. As will be more fully explained hereinbelow the bins 22 are used to receive and temporarily store coupons which have been determined to fall within a specific category.

The coupons are stored within a magazine or hopper 24 displaced from the conveyor belt 12. A picker means 26 is disposed between the hopper 24 and the belt 12. The picker means 26 includes a plurality of arms 28 through 42 which rotate in the direction of the arrow 44. Each of the arms 28 through 42 includes a pick-up means such as a suction cup 47 (FIG. 3). As the arms 28 through 42 rotate, the arm over the hopper 24, such as arm 32, picks up the top most coupon therefrom and transports the coupon to a loading station 46 which is defined by that pocket on the conveyor belt immediately opposite the hopper 24.

When the coupon deposited at the loading station reaches the reader means 48, the information contained upon the coupon in the typical bar code is deciphered and signals responsive thereto are generated. An additional reader means 49 may be disposed below the path followed by the suction cups 47 and between the hopper 24 and the loading station 46. The reader means 49 is adapted to read any bar codes or other pertinent information appearing on the bottom of the coupon. An appropriate data processing unit receives the signals generated by the reader means 48 and/or 49 and through a look-up table stored in its memory ascertains the precise one of the receiving bins 22 which has been predetermined to receive any such coupon bearing the signals generated by the bar code which identify the source of the coupon as well as the other pertinent information contained thereon. An appropriate tracking means such as a photo-electric cell 50 detects the flights such as shown at 52 and 54 in FIG. 1 which define the limits of the pockets on the surface of the conveyor belt 12. Through the utilization of the data processing unit and the signals developed by the photo-electric cell 50 the position of the coupon detected by the reader means 48 can be determined at all times. When the coupon is adjacent the bin 22 with which it has been identified a jet of air is caused to pass through a nozzle 56 by activation of a solenoid 58. When the solenoid 58 is activated by an appropriate electrical signal generated as a result of the coincidence of the coupon such, for example, as the one shown at 60 being adjacent its predetermined receiving bin, such as shown at 62, compressed air from a source 116 is ejected through the nozzle 56 to blow the coupon into the bin 62 as is shown by the arrow 64.

The magazine or hopper 24 may take any mechanical configuration desired dependent upon the specific construction of the automatic retail coupon sorter system. For example, as shown in FIG. 11, the hopper 24 may be constructed of a container 66 within which is disposed a spring means 68 upon which rests a plate 70 which receives a plurality of coupons 72. A retainer 74 is affixed to the container 66 and as by way of a finger-like structure or the like extends over the exposed top portion 76 of the top most coupon. It is important to recognize that the top surface of the coupon must remain exposed so that the picker means may make contact with it and remove it from the container 66. If desired the container 66 may be positioned upon a roll-up platform 78. In this manner when a magazine 24 is emptied a new magazine may be quickly rolled into place without stopping the operation of the automatic coupon sorter. Through such a structure workers may manually load the hopper 24 at some remote work station as the coupons are received. Through utilization of a plurality of such roll-up platforms 78 the automatic sorter system may be operated substantially continuously.

Alternatively, as shown in FIGS. 1 and 3 the magazine 24 may take the form of a receiver 80 into which there is positioned a readily removable cartridge 82 into which is loaded the coupons in a random fashion, irrespective of the coupon sizes as is shown in FIG. 11. Again, when the coupons are emptied from a particular cartridge the empty one may be removed and a new one immediately positioned in place, again permitting relatively continuous operation of the coupon sorter system. As is illustrated in FIGS. 1 through 3 the shell 80 is supported by an appropriate support mechanism 84 which is affixed to the support structure such as appropriate legs 86 and channel members 88 upon which the overall system rests and is structurally supported.

The picker means 26 is specifically designed to remove the top most exposed coupon from the magazine 24 and retain it in position on the picker until the coupon is in a position to be deposited at the loading station 46 on the moving conveyor belt 12. In accordance with the preferred embodiment of the present invention, the picker means includes the arms 28–42 each having a vacuum cup 47 at the terminus thereof. The arms are connected to a central body 90 made up of a pair of bearing plates 92 and 94 which are stationary and a pair of top plates 96 and 98 which rotate. The top plate 98 and the bearing plate 92 are preferably constructed of metal such as aluminum. The bearing plate 94 and the top plate 96 are preferably constructed of a dissimilar material such as plastic. As above pointed out, each of the arms on the picker means includes a suction cup 47 and has a vacuum hose 100 connected between the suction cup 47 and the central body 90 so that at the appropriate time when one of the suction cups attached to the arms 28–42 is adjacent the hopper 24, vacuum will automatically be applied to the suction cup and it will be maintained until it is time to deposit the coupon at the loading station 46.

Figure 4:
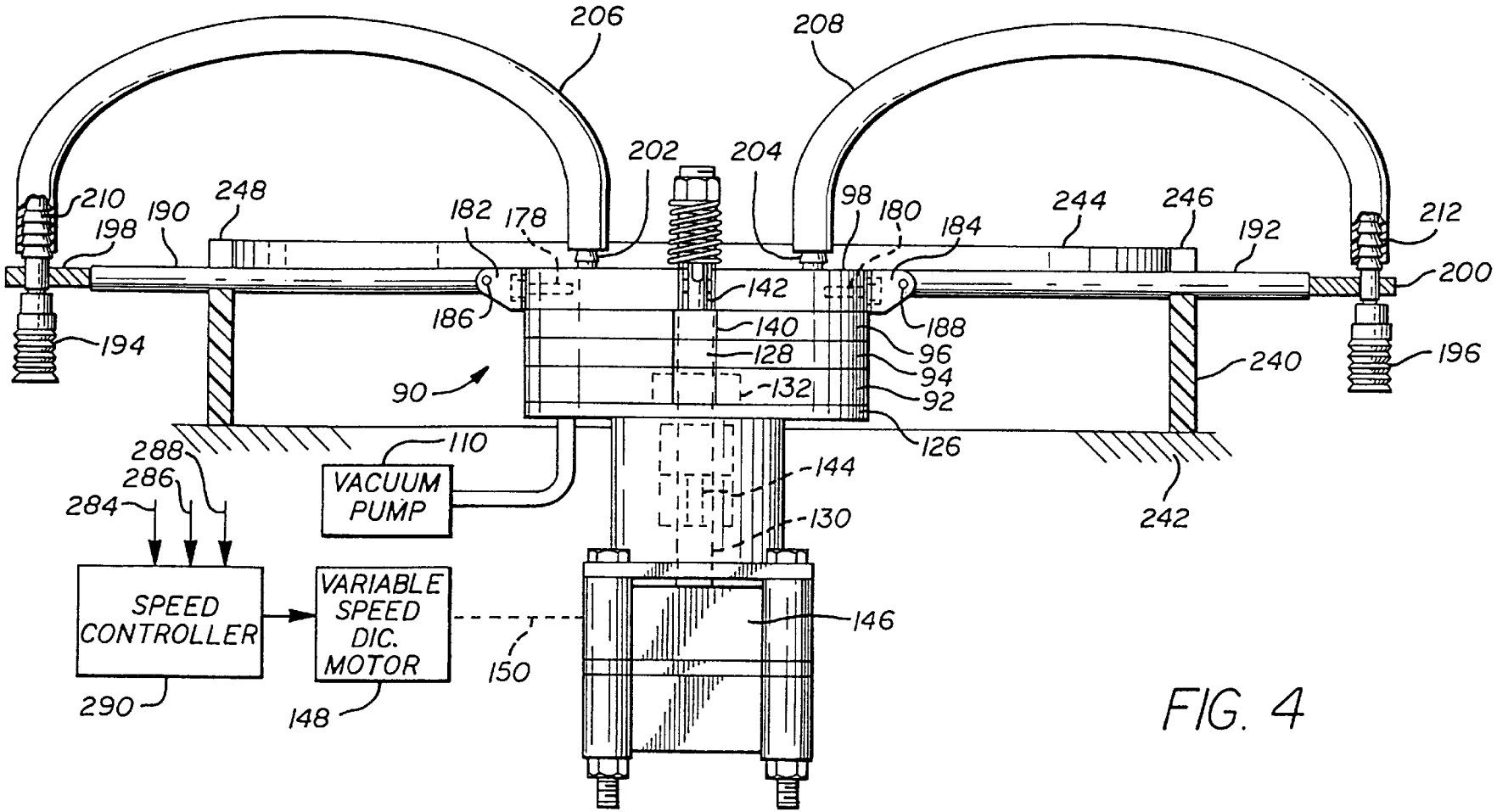
FIG. 4 is a schematic representation of one embodiment of a coupon picker apparatus used in the system of the present invention.

The bearing plate 94 includes an upper surface 102 (FIG. 5). The upper surface 102 defines an arcuate channel 104 therein. As is noted, the arcuate channel 104 extends slightly more that 180 degrees and is displaced inwardly from the outside edge 106 of the bearing plate 94. An opening 108 extends through the bearing plate 94 and intersects with the arcuate channel 104. A similar opening mating with opening 108 also extends through the bearing plate 92 and the opening is connected with a source of vacuum, such as a vacuum pump 110 or the like. An opening 112 is also defined within the surface 102 and is connected by a passageway 114 formed in the body of the bearing plate 94. The passageway 114 is connected by an appropriate fitting and a hose to the source of air under pressure 116. Openings 118, 120, 122 and 124 extend through the bearing plate 94 as do similar openings in the bearing plate 92. These openings are provided to secure the bearing plates 92 and 94 to a base plate 126 on the central body 90. A central opening 128 is provided through the bearing plates to receive a drive shaft shown in dash lines at 130 (FIG. 4). The opening in the bearing plate 92 is shown in dash lines 132.

Now by reference to FIGS. 7 and 8, the structure of the top plate 98 will be described. As is therein shown, the top plate 98 includes a lower surface 134. The lower surface 134 is affixed to the top surface of the top plate 96. Each of the top plates 96 and 98 include the same through openings. A central opening 136 defining a keyway 138 is defined through the top plate 98. A similar opening and keyway 140 is defined through the top plate 96. Openings 142–146, along with similar openings provided in the top plate 96, are utilized to secure the top plates 96 and 98 together. The keyway 138 receives a key extending from a second shaft 142 extending downwardly through the openings 136, 140, 128 and 132 into engagement with the drive shaft 130. The second shaft 142 and the drive shaft 130 are keyed together by an appropriate key 144 and a reciprocal keyway defined therein. An appropriate gear box is disposed within the housing 146. The gear box is connected to a variable speed direct current motor 148 which is coupled thereto as is illustrated by the dash line 150. In operation, as the variable speed DC motor turns, the gear box 146 provides a reduction in speed to the shaft 130 and the shaft 130, in turn, rotates the shaft 142 and as a result the top plates 96 and 98 rotate therewith causing the arms 28–42 to rotate past the hopper 24 and the loading station 46.

Openings 152–174 are provided around the periphery 176 of the top plate 98. Each of these openings is threaded, as is shown more clearly in FIG. 8. Each of the openings 152–174 receives a threaded bolt as shown at 178 and 180. The bolt such as shown at 178 and 180 secures a clevis 182 and 184, respectively, to which the arms, such as shown at 190 and 192, are secured by the pivot pin 186 and 188, respectively. It will be recognized when considering FIGS. 4 and 7 that there is provision for twelve picker arms on this preferred embodiment. By referring to FIG. 1, it will be noted that there are eight such picker arms. It will therefore be recognized by those skilled in the art that the number of picker arms may be varied, depending upon the particular application and the throughput volume desired.

The picker arms 190 and 192 (it being understood that there are additional picker arms associated with each of the remaining openings 152–174 as shown in FIG. 7) will include suction cups as shown at 194 and 196 affixed adjacent the distal ends 198 and 200, respectively, thereof. An appropriate fitting 202 and 204 extends upwardly from the top plate 98 and receives one end of a vacuum hose 206 and 208, respectively. The opposite end of the vacuum hose 206 is fitted over a fitting 210 which is, in turn, secured to the arm 190 and is an integral part of the suction cup 94. A similar fitting 212 receives the other end of the vacuum hose 208. The fittings 202 and 204 are received within openings 214 and 226 selected from the openings 214–236 which extend through the top plate 98. Similar openings extend through the top plate 96 and mate with the openings 214–236. As is shown by the line 238, the openings 214–236 are equidistant from the center of the opening 136.

A cam member 240 (FIGS. 1, 4 and 12) is supported upon a base 242, as shown by the ground symbol. The base 242 may be affixed to the picker means by any means known to those skilled in the art, so long as it is disposed as shown in FIG. 4 to provide a camming surface 244 for the arms, such as shown at 190 and 192, affixed to the rotary top plate 98. As is shown, particularly in FIGS. 4 and 12, the camming surface 244 on opposed sides of the cam member 240 is recessed as shown at 246 and 248. It should be noted that there is a transitional slope between the surface 244 and the depressed surfaces 246 and 248 to allow a gradual movement of the arms 190 and 192 away from and toward the camming surface 244. When the arms are at the lower most portion of the camming surfaces 246 and 248, as shown in FIG. 4, the suction cup 196 is in contact with the top most exposed coupon in the hopper 24 while the suction cup 194 would be at the loading station 46.

OPERATION OF THE PICKER MEANS

By referring now more specifically to FIGS. 4–8 and 12, the operation of the picker means during functioning of the coupon sorter system will be described. When the apparatus is activated, the vacuum pump 110 and the source of air under pressure 116 are activated, thus causing vacuum to appear within the arcuate channel 104 and air pressure to appear at the opening 112, both continually. The variable speed motor through the gear box 146 and the shaft 130 rotates the arms attached to the openings 152–174 in the top plate 98 causing them to ride along the cam surface 244. As a particular arm, for example 192, approaches the beginning of the recess 246, it will move downwardly toward the position shown in FIG. 4 and just before it passes to the bottom thereof, the opening 226 will communicate with the channel 104 and have vacuum applied thereto, thus creating a vacuum in the suction cup 196 and the hose 208. At the same time, all of the other arms and vacuum cups attached to the openings 174 and 152–160 would also have the vacuum applied thereto. As the vacuum cup 196 touches the top most exposed coupon in the hopper 24, the coupon, through suction, adheres to the lower surface of the suction cup 196 and is retained thereon as the arm continues to rotate. As the arm passes from the lower most portion 246 of the recess cam surface, it will ride upwardly onto the surface 244 and remain in such an elevated position until it reaches the beginning of the recess 248. When such occurs, the arm will again move toward the position shown in FIG. 4 and upon reaching that position will be at the bottom of the recess cam surface 248. In that position, the suction cup with the coupon held on the lower surface thereof by suction is at the loading station 46. As the arm moves along the lower portion of the depression 248, while maintaining a movement which is synchronized with the speed of the conveyor belt 12, will move so that the opening 226 no longer is in register with the channel 104, but rather contacts the surface 102 of the bearing plate 94. When such occurs, the vacuum is released and the coupon will fall onto the loading station 46 of the conveyor belt 12. To absolutely assure that the coupon cannot remain affixed to the lower end of the suction cup, the opening 226 will, shortly after losing registration with the channel 104, register with the opening 112 and while momentarily registered therewith will receive compressed air at a relatively low pressure. As a result, if for some reason the coupon has stuck to the end of the suction cup, it will positively be removed therefrom and deposited upon the surface of the conveyor belt at the loading station.

As will be recognized by those skilled in the art, from the foregoing description, each of the arms attached to the openings 152–174 will oscillate from a position on the cam surface 244 to a position on the recessed cam surfaces 246 and 248 as they rotate. During the time that the openings 214–236 are in registration with the channel 104, suction will be applied through the appropriate vacuum hose to the suction cup affixed to the end of the respective arm. Coupons carried through this approximate 180 degrees of rotation will remain held, as a result of the suction, until such is released by the appropriate opening, leaving registration with the vacuum channel 104. Thus, the coupon will be lifted, rotated through approximately 180 degrees and then deposited upon the conveyor belt at the loading station. In this manner, there is a continuous picking of the coupon from the hopper and depositing the same on the conveyor belt as above referred to.

Although in this preferred embodiment the oscillation of the various arms has been accomplished through the utilization of the cam means 240, it should be understood that other mechanisms, such as hydraulic or mechanical, associated with the arms, may also be used to individually oscillate the arms into the desired positions as above described.

THE CONVEYOR BELT

Figure 9:
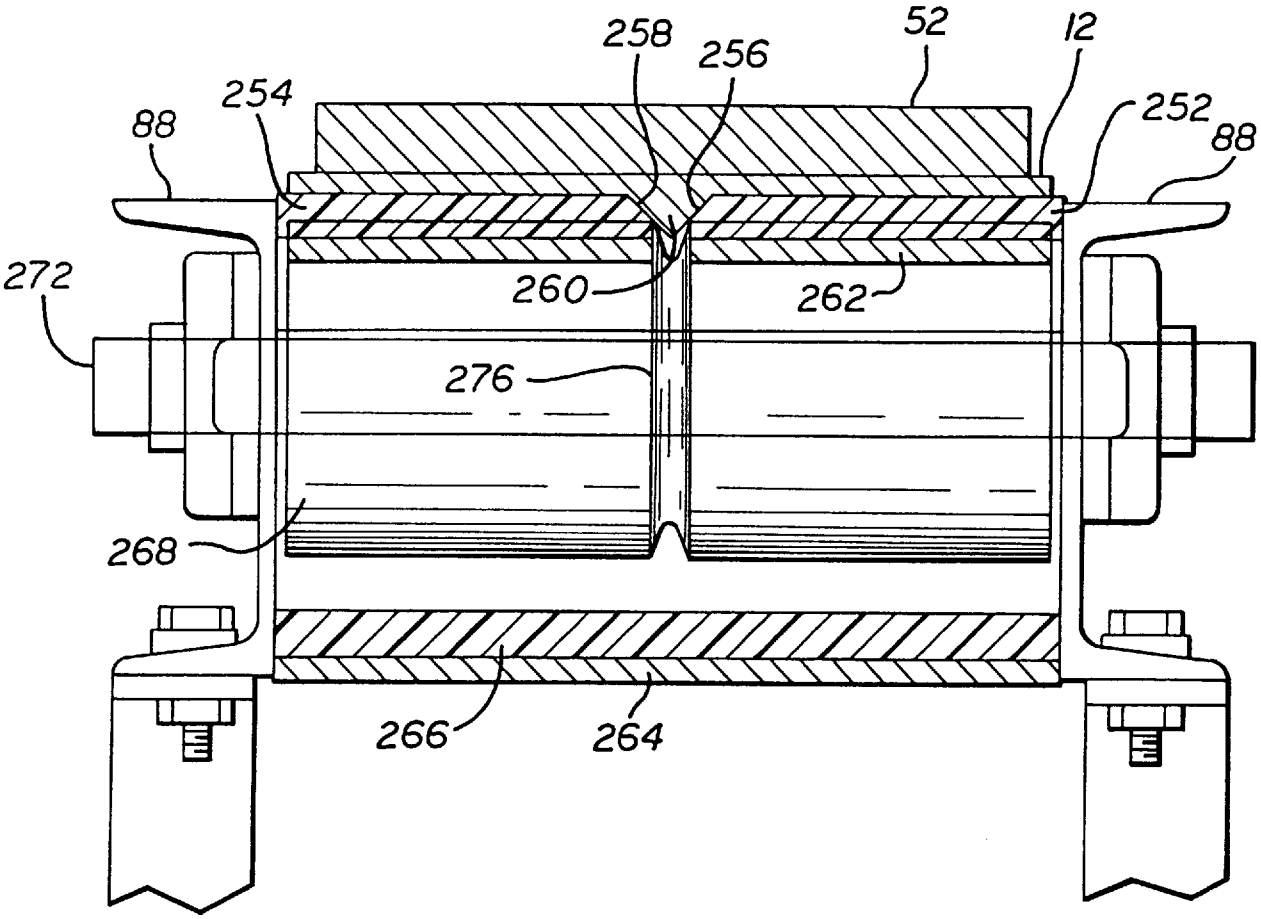
FIG. 9 is a schematic representation partly in cross-section illustrating the conveyor belt and its supporting and driving mechanism.

Referencing now FIGS. 9 and 10, the construction of the conveyor belt and the manner in which it is supported on the system is shown. As is therein illustrated, the channel beams 88 are supported upon an appropriate support system, such as the legs 250. As will be seen by reference to the other illustrations, particularly FIGS. 1 and 2, it can be seen that a plurality of such legs are utilized spaced along the beams 88 to support not only the conveyor belt but the receiving bins, control mechanisms and other portions of the system. The conveyor belt 12, with the flights, such as that shown at 52 supported thereon, rests upon a pair of plastic members 252 and 254 which have an upper surface slightly above the top surface of the channels 88. Each of the plastic members 252 and 254 have surfaces which are sloped as shown at 256 and 258 to provide effectively a V-shaped groove. The lower surface of the belt 12 has extending therefrom a V-shaped protrusion 260 which extends into and rides within the groove formed by the surfaces 256–258. In this manner, the conveyor belt 12 is caused to track in a true manner and not deviate side-to-side over its length. The plastic members 252 and 254 are supported upon an appropriate support member 262 which is affixed to the channels 88. A similar support member 264 is located below the conveyor belt 12 and also is affixed to the channels 88. The lower support member 264 also supports a plastic member 266 upon which the belt is allowed to rest as it returns to the top or operating surface forming the pockets between the flights there along. The belt 12 is caused to move along the length of the conveyor system by a drive roller 268 which is connected to an appropriate motor 270 (FIG. 1), which is coupled to the axle 272. As shown more clearly in FIG. 2, there is provided at the opposite end of the conveyor system, an appropriate tensioning mechanism 274 which may be extended to maintain the desired tension within the conveyor belt 12. The roller 268 also includes a central groove 276 which also receives the downwardly extending V-shaped protrusion 260 on the lower surface of the conveyor belt 12.

It will become apparent to those skilled in the art that it is extremely important that the speed of travel of the conveyor belt 12, in the direction as shown by the arrow 20 in FIG. 1, is synchronized with the movement of the picker arms as they rotate from the hopper 24 to the loading station 46 (FIG. 1). To insure such synchronization, there is provided a pair of proximity switches 278 and 280 which are disposed on a support member 282 to be activated when two of the plurality of arms are adjacent thereto. When the signal generated by the photoelectric cell 50, detecting a flight, and each of the two proximity switches 278 and 280 are closed, the speed of the arms and the conveyor belt are properly synchronized. Electrical signals generated by each of these three elements, the photo cell and the two proximity switches are applied as inputs 284, 286 and 288 of a speed controller 290, which in turn is coupled to the variable speed DC motor. If one or the other of the proximity switches is not activated at the same time as the photoelectric cell 50 detecting the passage of a flight, then the DC motor is either speeded up or slowed down in order to accomplish the desired synchronization.

While particular embodiments of the invention have been shown and described, it will be obvious to those skilled in the art that changes and modifications may be made including the material being sorted without departing from the invention in its broader aspects and therefore the aim in the appended claims is to cover all such changes and modifications as filed in the true spirit and scope of the invention.

What is claimed is:

1. An automatic sorter system for sorting sheets of material having identifying indicia thereon comprising:

A hopper for storing a plurality of said sheets stacked one upon the other in random order with a top sheet on the top of said stack exposed;

Retaining means engaging said top sheet and applying a force on said stacked sheets to retain said sheets in said hopper but allowing removal of the top sheet therefrom;

A plurality of destination bins,

A conveyor belt means divided into a plurality of pocket-like areas for transporting each of said sheets from a loading station to a predetermined one of said plurality of destination bins;

A picker means for removing said top sheet from said hopper and depositing it in a pocket-like area on said conveyor belt means at said loading station;

Reader means for scanning said top sheet to read the indicia thereon and developing a first signal identifying said predetermined one of said destination bins as determined by said indicia in which said sheet is to be deposited;

Means for determining the distance between said loading station and said predetermined one of said destination bins;

Tracking means associated with said conveyor belt means for determining when said top sheet has been moved by said conveyor belt means from said loading station to said predetermined one of said destination bins and for developing a second signal indicative thereof;

Blower means for removing said top sheet from said pocket in said conveyor belt and depositing it in said one of said destination bins; and Means for activating said blower means responsive to said second signal.

2. An automatic retail store coupon sorter system as defined in claim 1 wherein said picker means includes a plurality of arms, each attached at one end to a central member and having a pick-up means affixed to the other end thereof.

3. An automatic retail store coupon sorter system as defined in claim 2 which further includes first drive means coupled to said central member for rotating said pick-up means past said exposed top coupon.

4. An automatic retail store coupon sorter system as defined in claim 3 wherein said pick-up means includes a suction cup and said system further includes means for applying a vacuum to each said suction cup only during the time each said suction cup moves from a point preceding said top coupon to said loading station and for releasing said vacuum at said loading station.

5. An automatic retail store coupon sorter system as defined in claim 4 wherein said system further includes means for momentarily applying gas under pressure to each said suction cup at said loading station after said vacuum is released therefrom.

6. An automatic sorter system for sorting sheets of material having identifying indicia thereon as defined in claim 1 wherein said continuous conveyor belt includes an outer surface, a plurality of spaced apart outwardly directed members extending from said outer surface of said conveyor belt thereby dividing said conveyor belt means into said plurality of pocket-like areas.

7. An automatic sorter system for sorting sheets of material having identifying indicia thereon as defined in claim 6 wherein said tracking means includes a photoelectric cell disposed adjacent said outer surface of said conveyor belt and adapted to provide a signal as each said outwardly extending member passes said photocell.

8. An automatic sorter system for sorting sheets of material having identifying indicia thereon as defined in claim 7 wherein said reader means is disposed over said conveyor belt means downstream from said loading station.

9. An automatic sorter system for sorting sheets of material having identifying indicia thereon as defined in claim 8 wherein said reader means includes first and second optical scanners.

10. An automatic sorter system for sorting sheets of material having identifying indicia thereon as defined in claim 1 wherein said blower means includes a plurality of nozzle means each disposed to direct an air jet across said conveyor belt means toward one of said plurality of predetermined destination bins, said nozzle means being intermittently operative only in response to said second signal.

11. The method of automatically sorting sheets of material having indicia thereon comprising the steps of:

Storing sheets of said material in a storage area;

Removing sheets one at a time from said storage area;

Depositing each said sheet after its removal on a conveyor belt having a surface divided into a plurality of pocket-like areas by members extending outwardly from said surface at a loading station disposed remote from said storage area;

Reading each said sheet to ascertain information therefrom;

Identifying from such information a predetermined address of a receiving bin into which such sheet is to be placed;

Tracking the position of said sheet on said belt by counting each said outwardly extending member to determine when said sheet arrives at said address of said receiving bin; and Activating an air jet to propel the sheet from said belt into said receiving bin.

12. An automatic sorter system for sorting sheets of material having identifying indicia thereon comprising:

A hopper for storing a plurality of said sheets stacked one upon the other in random order with a top sheet on top of said stack exposed;

A plurality of destination bins,

A conveyor belt means for transporting each of said sheets from a loading station to one of said plurality of destination bins;

A central member;

A picker means for removing said top sheet from said hopper and depositing it on said conveyor belt means at said loading station, said picker means including a plurality of arms, each attached at one end to a said central member and having a pick-up means including a suction cup affixed to the other end thereof;

First drive means coupled to said central member for rotating said pick-up means past said exposed top sheet;

Means for applying a vacuum to each said suction cup only during the time each said suction cup moves from a point preceding said top sheet to said loading station and for releasing said vacuum at said loading station, said means for applying a vacuum including a first stationary plate defining a channel therein, a source of vacuum, means coupling said source of vacuum to said channel, and a rotating plate having a plurality of openings therethrough disposed such that a portion of said openings register with said channel as said rotating plate is rotated, Reader means for scanning said top sheet and developing a first signal identifying one of said destination bins in which said top sheet is to be deposited;

Means for determining the distance between said loading station and said one of said destination bins;

Tracking means associated with said conveyor belt means for determining when said top sheet has been moved by said conveyor belt means from said loading station to said one of said destination bins and for developing a second signal indicative thereof;

Blower means for removing said top sheet from said conveyor belt and depositing it in said one of said destination bins; and Means for activating said blower means responsive to said second signal.

13. An automatic retail store coupon sorter system as defined in claim 12 wherein each of said plurality of arms is attached to said rotating plate.

14. An automatic retail store coupon sorter system as defined in claim 13 wherein said suction cup on each of said arms is connected to said opening in said rotating plate which registers with said channel to thereby apply vacuum to said suction cup.

15. An automatic sorter system for sorting sheets of material having identifying indicia thereon comprising:

A hopper for storing a plurality of said sheets stacked one upon the other in random order with a top sheet coupon on top of said stack exposed;

A plurality of destination bins,

A conveyor belt means for transporting each of said sheets from a loading station to one of said plurality of destination bins;

A picker means for removing said top sheet from said hopper and depositing it on said conveyor belt means at said loading station, said picker means including a plurality of arms each attached at one end to a central member and having a pick-up means affixed to the other end thereof;

Means defining a camming surface disposed so that said arms ride upon said camming surface;

Reader means for scanning said top sheet and developing a first signal identifying one of said destination bins in which said top sheet is to be deposited;

Means for determining the distance between said loading station and said one of said destination bins;

Tracking means associated with said conveyor belt means for determining when said top sheet has been moved by said conveyor belt means from said loading station to said one of said destination bins and for developing a second signal indicative thereof;

Blower means for removing said top sheet from said conveyor belt and depositing it in said one of said destination bins; and Means for activating said blower means responsive to said second signal.

16. An automatic retail store coupon sorter system as defined in claim 15 wherein said camming surface includes first and second depressed surfaces, one of said depressed surfaces being disposed adjacent said hopper and the other of said depressed surfaces being disposed adjacent said loading station.

17. An automatic retail store coupon sorter system as defined in claim 16 wherein each said arm as it traverses said first depressed camming surface causes the suction cup thereon to engage a coupon in said hopper and to remove the top most coupon therefrom.

18. An automatic retail store coupon sorter system as defined in claim 17 wherein as each said arm traverses said second depressed cam surface the suction cup affixed thereto moves so as to position the coupon held by the suction cup immediately over said loading station.

19. An automatic sorter system for sorting sheets of material having identifying indicia thereon comprising:

A hopper for storing a plurality of said sheets stacked one upon the other in random order with a top sheet on top of said stack exposed;

A plurality of destination bins, A conveyor belt means for transporting each of said sheets from a loading station to one of said plurality of destination bins;

A picker means for removing said top sheet from said hopper and depositing it on said conveyor belt means at said loading station, said picker means including a plurality of arms, each attached at one end to a central member and having a pick-up means affixed to the other end thereof;

A variable speed direct current motor, means coupling said motor to said picker means and means for controlling the speed of said variable speed DC motor;

Said coupling means including a gear box connected to said direct current motor, a shaft which is rotated by said gear box, and a rod connected to said picker means for rotating said arms, said rod being coupled to said shaft by a key and a keyway;

Reader means for scanning said top sheet and developing a first signal identifying one of said destination bins in which said top sheet is to be deposited;

Means for determining the distance between said loading station and said one of said destination bins;

Tracking means associated with said conveyor belt means for determining when said top sheet has been moved by said conveyor belt means from said loading station to said one of said destination bins and for developing a second signal indicative thereof;

Blower means for removing said top sheet from said conveyor belt and depositing it in said one of said destination bins; and Means for activating said blower means responsive to said second signal.

20. An automatic sorter system for sorting sheets of material having identifying indicia thereon comprising:

A hopper for storing a plurality of said sheets stacked one upon the other in random order with a top sheet on top of said stack exposed;

A plurality of destination bins,

A conveyor belt means for transporting each of said sheets from a loading station to one of said plurality of destination bins;

A picker means for removing said top sheet from said hopper and depositing it on said conveyor belt means at said loading station;

Said picker means including a plurality of arms, each attached at one end to a central member and having a pick-up means affixed to the other end thereof;

A variable speed direct current motor, means coupling said motor to said picker means and means for controlling the speed of said variable speed DC motor;

First and second proximity switches disposed such that adjacent arms of said plurality of arms can simultaneously activate said proximity switches, means for determining the speed of travel of said conveyor belt means, lack of coincidence between activation of said proximity switches and the speed indication of said conveyor belt means generating a signal for changing the speed of said variable speed direct current motor;

Reader means for scanning said top sheet and developing a first signal identifying one of said destination bins in which said top sheet is to be deposited;

Means for determining the distance between said loading station and said one of said destination bins;

Tracking means associated with said conveyor belt means for determining when said top sheet has been moved by said conveyor belt means from said loading station to said one of said destination bins and for developing a second signal indicative thereof;

Blower means for removing said top sheet from said conveyor belt and depositing it in said one of said destination bins; and Means for activating said blower means responsive to to said second signal.

21. An automatic sorter system for sorting sheets of material having identifying indicia thereon comprising:

A hopper for storing a plurality of said sheets stacked one upon the other in random order with a top sheet on top of said stack exposed;

A plurality of destination bins,

A conveyor belt means for transporting each of said sheets from a loading station to one of said plurality of destination bins;

Said conveyor belt means including an elongated support means having a roller at each end thereof, a stationary support means having a flat surface disposed adjacent each said roller and extending therebetween, and a continuous conveyor belt engaging each of said rollers and said flat surface of said support means;

Said support means defining a V-shaped groove therein and said belt including a V-shaped protrusion extending therefrom, said protrusion riding within said groove;

A picker means for removing said top sheet from said hopper and depositing it on said conveyor belt means at said loading station;

Reader means for scanning said top sheet and developing a first signal identifying one of said destination bins in which said top sheet is to be deposited;

Means for determining the distance between said loading station and said one of said destination bins;

Tracking means associated with said conveyor belt means for determining when said top sheet has been moved by said conveyor belt means from said loading station to said one of said destination bins and for developing a second signal indicative thereof;

Blower means for removing said top sheet from said conveyor belt and depositing it in said one of said destination bins; and Means for activating said blower means responsive to said second signal.

22. An automatic retail sorter system for sorting sheets of material having identifying indicia thereon comprising:

A hopper for storing a plurality of said sheets stacked one upon the other in random order with a top sheet on top of said stack exposed;

A plurality of destination bins,

A conveyor belt means for transporting each of said sheets from a loading station to one of said plurality of destination bins;

Said conveyor belt means including an elongated support means having a roller at each end thereof, a stationary support means having a flat surface disposed adjacent each said roller and extending therebetween, and a continuous conveyor belt engaging each of said rollers and said flat surface of said support means, said continuous conveyor belt including an outer surface, a plurality of spaced apart outwardly directed members extending from said outer surface of said conveyor belt thereby dividing said conveyor belt into a number of pocket-like areas;

A picker means for removing said top sheet from said hopper and depositing it on said conveyor belt means at said loading station;

Reader means including first and second optical scanners for scanning said top sheet and developing a first signal identifying one of said destination bins in which said top sheet is to be deposited;

Third optical scanner disposed between said hopper means and said loading station and adapted to read a lower surface of said sheet;

Means for determining the distance between said loading station and said one of said destination bins;

Tracking means associated with said conveyor belt means for determining when said top sheet has been moved by said conveyor belt means from said loading station to said one of said destination bins and for developing a second signal indicative thereof;

Blower means for removing said top sheet from said conveyor belt and depositing it in said one of said destination bins; and Means for activating said blower means responsive to said second signal.

23. A automatic sorter system for sorting sheets of material having identifying indicia thereon comprising:

A hopper for storing a plurality of said sheets stacked one upon the other in random order with a top sheet on top of said stack exposed;

A plurality of destination bins,

A conveyor belt means for transporting each of said sheets from a loading station to one of said plurality of destination bins;

Said conveyor belt means including an elongated support means having a roller at each end thereof, a stationary support means having a flat surface disposed adjacent each said roller and extending therebetween, and a continuous conveyor belt engaging each of said rollers and said flat surface of said support means, said continuous conveyor belt including an outer surface, a plurality of spaced apart outwardly directed members extending from said outer surface of said conveyor belt thereby dividing said conveyor belt into a number of pocket-like areas;

A picker means for removing said top sheet from said hopper and depositing it on said conveyor belt means at said loading station;

Reader means including first and second optical scanners for scanning said top sheet and developing a first signal identifying one of said destination bins in which said top sheet is to be deposited;

A third optical scanner disposed between said hopper means and said loading station and adapted to read a lower surface of said sheet;

Means for determining the distance between said loading station and said one of said destination bins;

Tracking means associated with said conveyor belt means for determining when said top sheet has been moved by said conveyor belt means from said loading station to said one of said destination bins and for developing a second signal indicative thereof;

Blower means including a nozzle for removing said top sheet from said conveyor belt and depositing it in said one of said destination bins; and Means for activating said blower means responsive to said second signal, said means for activating said blower means including an electrically operated solenoid connected to said nozzle, said solenoid being electrically activated only when said second signal is generated.

* * * * *